US011241073B2

(12) United States Patent
Jung et al.

(10) Patent No.: US 11,241,073 B2
(45) Date of Patent: Feb. 8, 2022

(54) COSMETIC CONTAINER INCLUDING REFILLABLE INNER CONTAINER

(71) Applicant: YONWOO CO., LTD., Incheon (KR)

(72) Inventors: Seo Hui Jung, Incheon (KR); Yu Seob Kim, Incheon (KR)

(73) Assignee: YONWOO CO., LTD., Incheon (KR)

( * ) Notice: Subject to any disclaimer, the term of this patent is extended or adjusted under 35 U.S.C. 154(b) by 0 days.

(21) Appl. No.: 16/604,234

(22) PCT Filed: Apr. 23, 2019

(86) PCT No.: PCT/KR2019/004898

§ 371 (c)(1),
(2) Date: Oct. 10, 2019

(87) PCT Pub. No.: WO2020/032346

PCT Pub. Date: Feb. 13, 2020

(65) Prior Publication Data

US 2020/0383453 A1 Dec. 10, 2020

(30) Foreign Application Priority Data

Aug. 10, 2018 (KR) ..... 10-2018-0093684

(51) Int. Cl.
*A45D 34/04* (2006.01)
*A45D 34/00* (2006.01)
(Continued)

(52) U.S. Cl.
CPC ..... *A45D 34/04* (2013.01); *A45D 40/26* (2013.01); *A45D 40/22* (2013.01);
(Continued)

(58) Field of Classification Search
CPC ..... A45D 34/04; A45D 2034/005; A45D 2200/056; A45D 2034/007
See application file for complete search history.

(56) References Cited

U.S. PATENT DOCUMENTS 3,987,935 A 10/1976 Caluscos
9,775,421 B2 * 10/2017 Kim ..... A45D 34/04
(Continued)

FOREIGN PATENT DOCUMENTS

CN 201243725 Y 5/2009
EP 2767186 A1 8/2014
(Continued)

OTHER PUBLICATIONS

PCT International Search Report, PCT/KR2019/004898, dated Jul. 29, 2019.

*Primary Examiner* — David P Angwin
*Assistant Examiner* — Bradley S Oliver
(74) *Attorney, Agent, or Firm* — Novick, Kim & Lee, PLLC; Sang Ho Lee; Hyun Woo Shin

(57) ABSTRACT

Provided is a cosmetic container including a refillable inner container. The cosmetic container includes an inner container in which contents are stored, a container body in which the inner container is accommodated, a discharger configured to discharge the contents accommodated in the inner container, a distributor configured to distribute the contents discharged by the discharger, and an upper cap configured to seal the container body. Here, an open portion is formed on one side of the container body, the inner container is insertable into the container body through the open portion, and the inner container is separable from the container body through the open portion.

13 Claims, 5 Drawing Sheets

(51) Int. Cl.
*A45D 40/26* (2006.01)
*A45D 40/22* (2006.01)
*A45D 40/00* (2006.01)

(52) U.S. Cl.
CPC ..... *A45D 2034/002* (2013.01); *A45D 2040/0006* (2013.01); *A45D 2200/056* (2013.01); *A45D 2200/057* (2013.01)

(56) References Cited

U.S. PATENT DOCUMENTS

| | | | | |
|---|---|---|---|---|
| 10,010,153 | B2 * | 7/2018 | Kim | A45D 34/00 |
| 10,709,223 | B1 * | 7/2020 | Kim | B05B 11/3001 |
| 2007/0172307 | A1 * | 7/2007 | Jo | A45D 34/042 401/279 |
| 2018/0192761 | A1 | 7/2018 | McMahon | |

FOREIGN PATENT DOCUMENTS

| | | | |
|---|---|---|---|
| JP | 2009-540902 | A | 11/2009 |
| JP | 2014-008075 | A | 1/2014 |
| JP | 2016-528991 | A | 9/2016 |
| KR | 20-0450028 | Y1 | 9/2010 |
| KR | 10-1231786 | B1 | 2/2013 |
| KR | 10-1527758 | B1 | 6/2015 |
| KR | 101552900 | B1 * | 9/2015 |
| KR | 20-0482745 | Y1 | 3/2017 |
| KR | 20-0483953 | Y1 | 7/2017 |
| KR | 10-2018-0004340 | A | 1/2018 |
| WO | 2018/096250 | A1 | 5/2018 |

* cited by examiner

COSMETIC CONTAINER INCLUDING REFILLABLE INNER CONTAINER

TECHNICAL FIELD

The present invention relates to a cosmetic container, and more particularly, to a cosmetic container including a refillable inner container.

BACKGROUND ART

A cosmetic container, particularly, a compact container, is a container which mainly accommodates cosmetic materials therein such that a user takes cosmetic materials accommodated in the compact container using a separate cosmetic tool such as a puff and applies cosmetic materials to a human body, such as a face, a body, and the like of the user, to simply apply makeup. Cosmetic compact containers are manufactured to have a variety of general shapes such as a circular shape and a quadrangular shape and designed to have a relatively small volume to be carried easily. Such cosmetic compact containers are used for accommodating not only cosmetic materials for color makeup such as powder-type finishing powder and solid-type compressed powder but also fluid-type cosmetic materials including liquid-type foundation as cosmetic materials for color makeup and gel-type sun cream as cosmetic materials for skincare.

In the case of conventional cosmetic compact containers, when all cosmetic materials accommodated therein are exhausted or a user wants to use new cosmetic materials in addition to existing cosmetic materials, it is necessary to buy a new compact container itself. However, in consideration of a considerable cost for buying a new compact container or a possibility of an exterior of a compact container accommodating new cosmetic materials not suiting a user's taste, new compact containers, in which only an inner container accommodating cosmetic materials may be replaced more easily while the compact container remains as it is, are in demand.

Consequently, refillable cosmetic containers in which an inner container accommodating cosmetic materials is replaceable have been developed. However, such containers are configured to attach or detach an inner container from above or below a container body and have a problem that the inner container is not attachable or detachable using one hand. That is, since the container is gripped by one hand and an inner container for a refill is inserted into or removed from the container body by another hand to stably attach or detach the inner container from above or below the container body, it is necessary to use both hands. When both hands are used to attach or detach the inner container for a refill, for example, it is difficult to replace the inner container while cosmetic materials are applied to a human body such as a face, a body, and the like or to replace the inner container while another item is held by one hand.

Also, in the case of compact containers configured to attach or detach an inner container from above a container body, generally, in consideration of an upper cap connected to one side of the container body, an attaching or detaching operation is considerably disturbed by the connected upper cap and there is a risk that cosmetic materials in the inner container easily leak outside the compact container during the attaching or detaching operation.

In addition, conventional compact containers for a refill have a problem that cosmetic materials accommodated in an inner container are exposed to the air and easily exposed to bacteria and the like after a plurality of instances of usage.

DISCLOSURE

Technical Problem

The present invention is directed to providing a novel cosmetic container in which only an inner container which accommodates cosmetic materials is replaceable more easily while a cosmetic container body remains as it is.

The present invention is also directed to providing a refillable cosmetic container having a novel structure in which an inner container for a refill is attachable or detachable through a side surface of a container body such that the inner container for a refill may be easily attached or detached with only one hand.

The present invention is also directed to providing a cosmetic container in which when an inner container coupled inside a container body is pressurized, as much of cosmetic materials sealed hygienically in the inner container as needed are discharged outward so as to provide fresh cosmetic materials which are not contaminated by bacteria.

Additional technical aspects of the present invention are not limited to the above-stated technical aspect and other unstated technical aspects will be clearly understood by those skilled in the art from the following description.

Technical Solution

One aspect of the present invention provides a cosmetic container including an inner container in which contents are stored, a container body in which the inner container is accommodated, a discharge means configured to discharge the contents accommodated in the inner container, a distributor configured to distribute the contents discharged by the discharge means, and an upper cap configured to seal the container body. Here, an open portion is formed on one side of the container body, the inner container is insertable into the container body through the open portion, and the inner container is separable from the container body through the open portion.

The open portion may be formed on a side surface of the container body.

The discharge means may include a pump and a pump nozzle.

The pump may be formed in the inner container, the pump nozzle may be formed in the distributor, and the pump may be coupled with the pump nozzle when the inner container is inserted into the container body.

The pump may be an airless pump or a dip-tube type pump.

When the pump is an airless pump, the inner container may include a movable film or a movable piston or may be a contractible pouch type.

When the inner container is inserted into and then pressurized against an inside of the container body, the contents accommodated in the inner container may be discharged into the distributor by the discharge means.

The cosmetic container may include a holding portion configured to prevent the inner container inserted in the container body from being pressurized against an inside of the container body when the upper cap seals the container body.

The holding portion may be formed on the upper cap.

One or more holding portions may be formed along a perimeter of the upper cap.

The inner container may include a storage portion, in which cosmetic contents are stored, and an outer circumferential portion formed to protrude from at least one surface of the storage portion.

The outer circumferential portion may form one surface of the container body when the inner container is inserted into the container body.

The cosmetic container may include a grip portion for gripping a part of the inner container that is formed on one side of the container body.

The grip portion may be formed in a space between an open portion of the container body and an outer circumferential portion of the inner container.

The distributor may include an intermediate body to which the discharge means is coupled and a distributing plate coupled with a top of the intermediate body and configured to distribute contents.

The distributing plate may include a distribution path to distribute the contents discharged by the discharge means.

The distributor may further include a mesh.

Advantageous Effects

According to the present invention, while a cosmetic container body remains as it is, only an inner container which accommodates cosmetic materials may be replaced more easily.

The inner container is attachable or detachable through a side surface of the container body such that the inner container for a refill may be easily attached or detached with only one hand.

When the inner container coupled inside the container body is pressurized, as much of cosmetic materials sealed hygienically in the inner container as needed are discharged outward so as to provide fresh cosmetic materials which are not contaminated by bacteria.

MODES OF THE INVENTION

Figure 1:
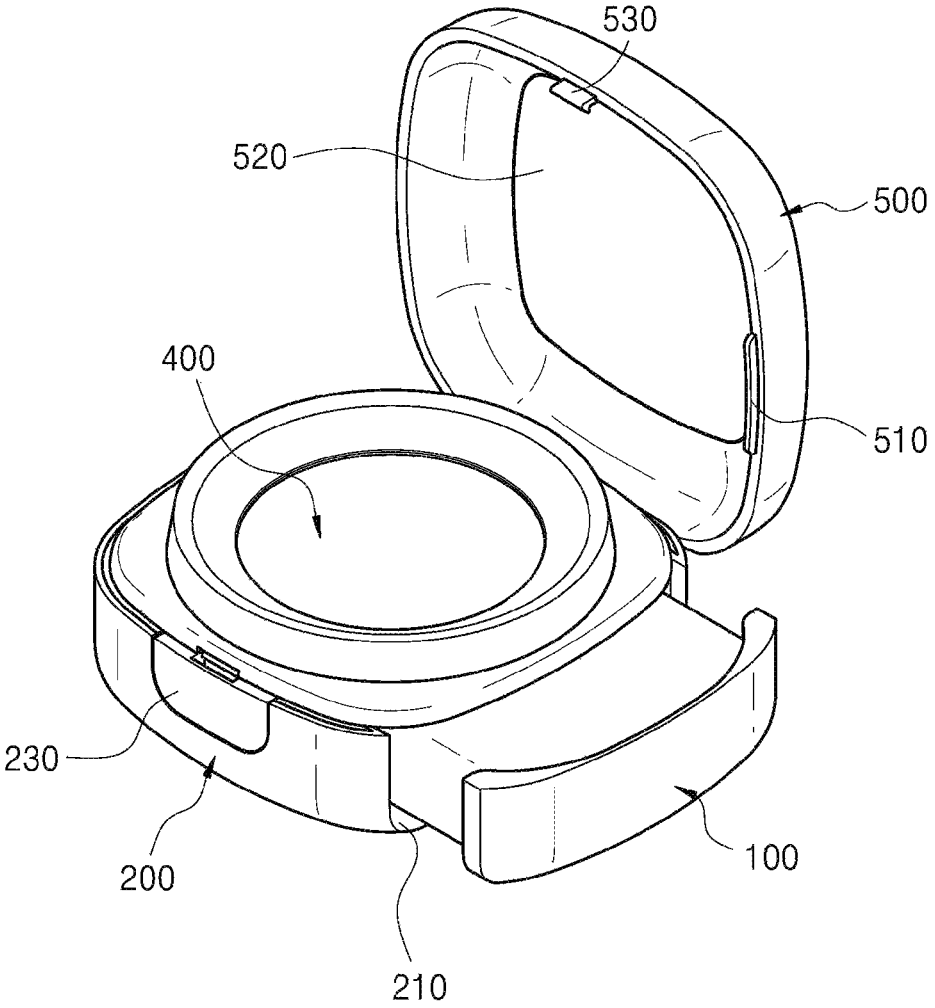
FIG. 1 is a view illustrating a state in which an upper cap of a cosmetic container is opened and an inner container is separated from a container body according to one embodiment of the present invention.

Hereinafter, embodiments of the present invention will be described in detail with reference to the attached drawings.

In a description of the embodiments, technical content fully well known in the art and directly irrelevant to the present invention will be omitted. This is to more clearly deliver the essential of the present invention by omitting an unnecessary description. For the same reason, throughout the attached drawings, some components are exaggerated, omitted, or schematically illustrated.

Also, a size of each of the components does not reflect an actual size completely. In the drawings, like or corresponding components are referred to with like reference numerals.

Advantages and features of the present invention and a method of achieving the same will become apparent with reference to the attached drawings and embodiments described below in detail. However, the present invention is not limited to the following embodiments and may be embodied with a variety of different modifications. The embodiments are merely provided to allow one of ordinary skill in the art to completely understand the scope of the present invention and are defined by the scope of the claims. Throughout the specification, like reference numerals refer to like elements.

Throughout the specification, when one part is "connected" to another part, the one part is not only "directly connected" to the other part but also "indirectly connected" to the other part with another device interposed therebetween. Throughout the specification, when one part "includes" one component, unless particularly defined otherwise, the one part may not exclude another component but may further include another component. Also, in describing components of the embodiments of the present invention, terms such as first, second, A, B, (a), (b), and the like may be used. The terms are used only for distinguishing one element from another, and the essential, turn, order, and the like of the corresponding element will not be limited thereto.

Hereinafter, a cosmetic container according to the present invention will be described with reference to the drawings.

Figure 2:
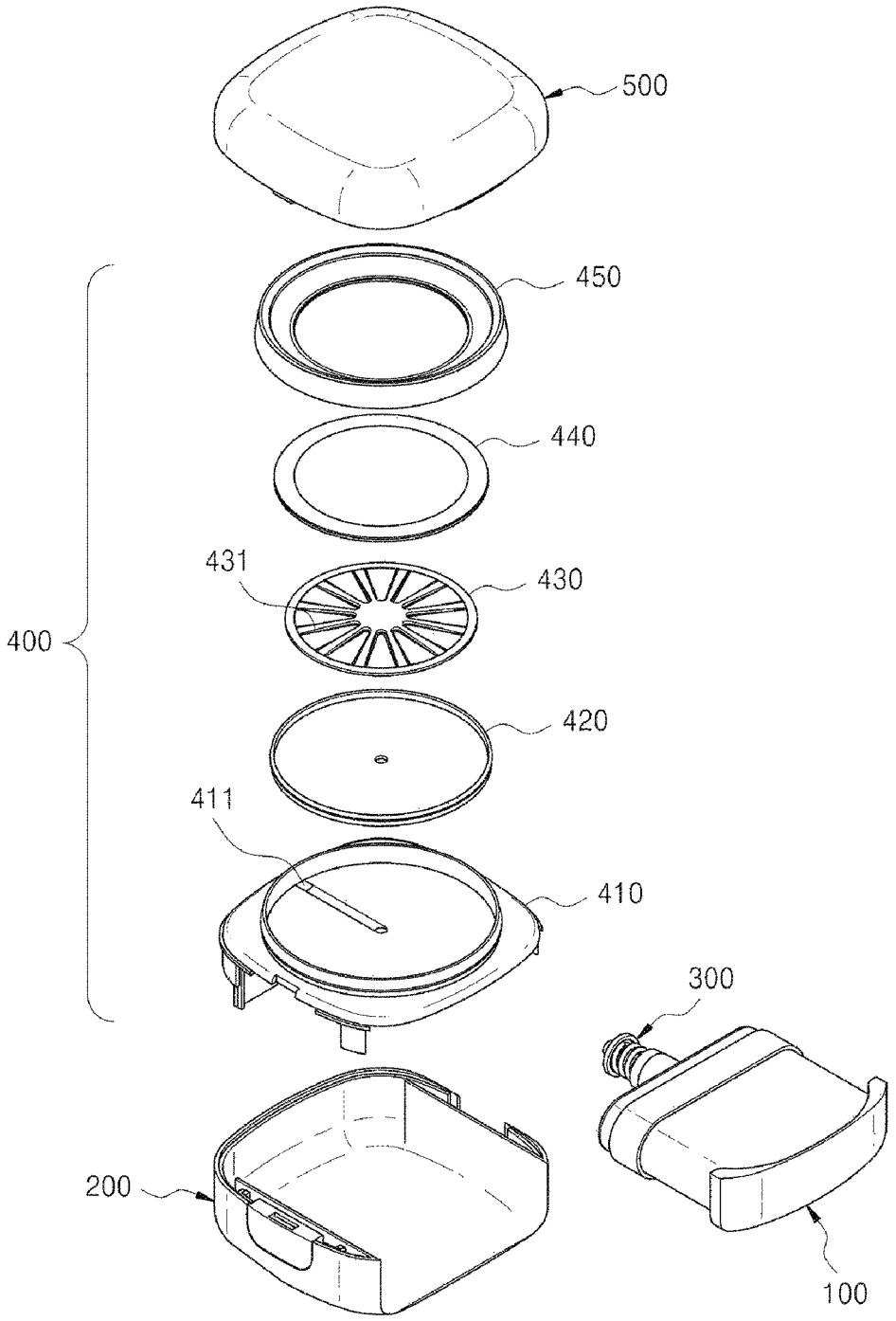
FIG. 2 is an exploded perspective view of the cosmetic container according to one embodiment of the present invention.

FIG. 1 is a view illustrating a state in which an upper cap of a cosmetic container is opened and an inner container is separated from a container body according to one embodiment of the present invention. FIG. 2 is an exploded perspective view of the cosmetic container according to one embodiment of the present invention, and FIG. 3 is a cross-sectional view of the cosmetic container according to one embodiment of the present invention.

Figure 3:
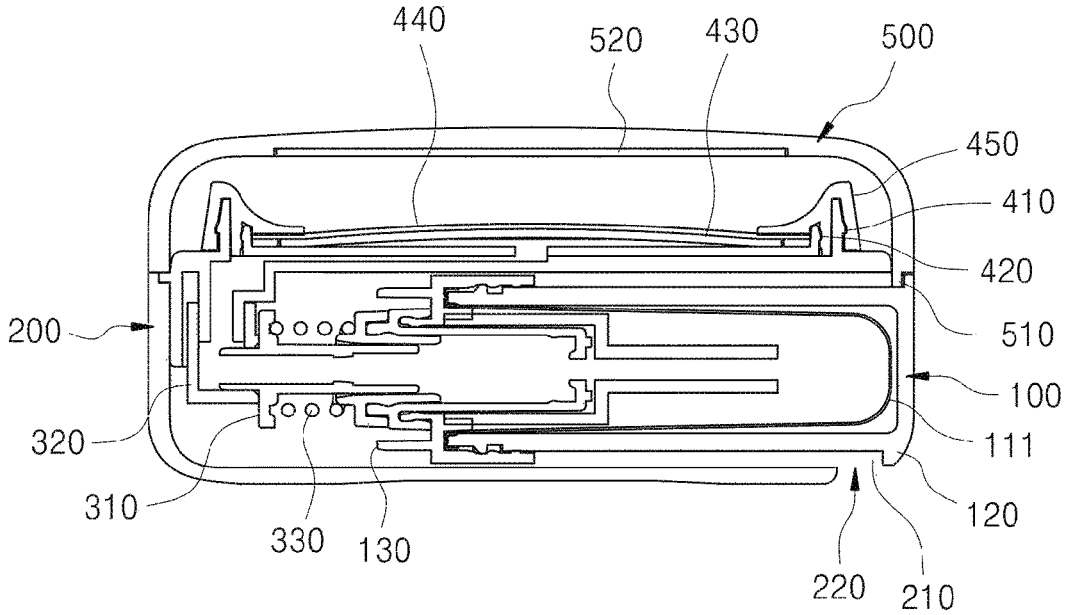
FIG. 3 is a cross-sectional view of the cosmetic container according to one embodiment of the present invention.

Referring to FIGS. 1 to 3, the cosmetic container according to one embodiment of the present invention may include an inner container 100 which stores contents, a container body 200, a discharge means 300, a distributor 400, and an upper cap 500.

The inner container 100 is a container storing contents, is insertable into the container body 200 through an open portion 210 formed in the container body 200, and is separable from the container body 200 through the open portion 210.

Here, "insertion" may mean the inner container 100 being led in into the container body 200 through the open portion 210 formed in the container body 200 or the inner container 100 being coupled with the container body 200 or another component of the container body 200, for example, the discharge means 300 after entering therein. Meanwhile, "separation" means the inner container 100 being released from the container body 200 and may include a state of the inner container 100 being removed from the container body 200 through the open portion 210 formed in the container body 200 or a state of the inner container 100 being movable while being partially inserted into the open portion 210.

Figure 4:
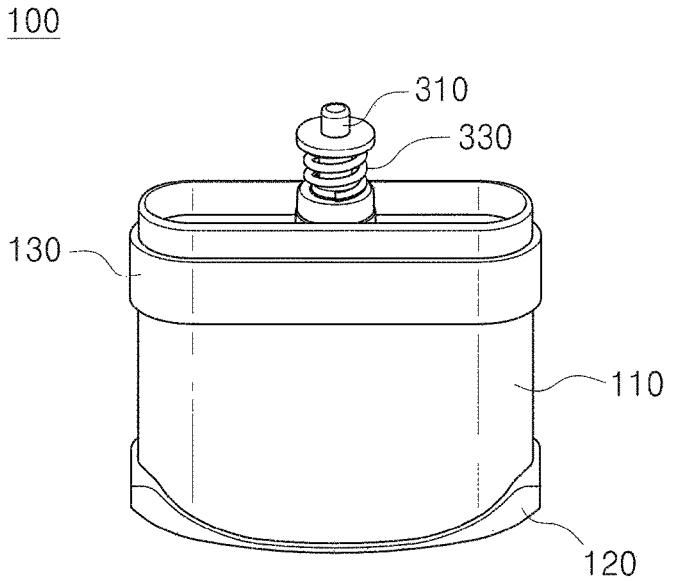
FIG. 4 is a view illustrating the inner container of the cosmetic container according to one embodiment of the present invention.

FIG. 4 is a view illustrating the inner container 100 of the cosmetic container according to one embodiment of the present invention. Hereinafter, components of the inner container 100 will be described with reference to FIG. 4.

The inner container 100 may include a storage portion 110, in which contents are stored, and an outer circumferential portion 120 formed to protrude from at least one surface of the storage portion. The outer circumferential portion 120 may be formed to have a greater width than that of the storage portion while surrounding the at least one surface of the storage portion and may protrude outward from the storage portion 110. In this case, when the inner container 100 is inserted into the container body 200, the outer circumferential portion 120 may form one surface of the container body 200 so as to smoothly connect the inner container 100 and the container body 200 to each other. The cosmetic container may be manufactured to have an external shape which includes fluid curves overall and provides smooth aesthetics according to a user's taste.

The inner container 100 may include a shoulder 130 having an upper outer surface in contact with an intermediate body 410 and a lower outer surface in contact with the container body 200 so as to be stably slidable into the container body 200 during an insertion process and to remain stable in the container body 200 after insertion.

A fluid contained in the inner container 100 may be a cosmetic fluid. The fluid contained in the inner container 100 may include cosmetic materials for color make-up such as a liquid type foundation or cosmetic materials for skin care such as a gel type suncream but is not limited thereto and may include all types of fluid-state cosmetic materials. In some embodiments, instead of a fluid, powder-type cosmetic materials or solid cosmetic materials may be contained in the inner container 100. In some embodiments, cosmetic materials including one or more of a fluid, powder, and solid may be contained in the inner container 100.

The inner container 100 may be formed of a film 111 or may include the film 111 in the storage portion 110. The film 111 may contain a fluid therein. The film 111 may be a material which is compressed and deformable according to a discharge of a fluid. The film 111 may have a multilayer formation of several thin sheets. Also, an inside thereof may be a vacuum. In this case, since the film 111 is compressed as a fluid is discharged, it is possible to use an entirety of a fluid in the storage portion 110 without residual contents. Also, it is possible to maintain a quality of and sanitary use of cosmetic materials by preventing problems such as deterioration, dryness, exposure, and the like caused by an air inflow when the cosmetic container is used.

The open portion 210 is formed in one side of the container body 200, and the inner container 100 may be inserted into the container body 200 through the open portion 210. In some embodiments, the inner container 100 may slide and be inserted into the container body 200 in a sliding manner.

The open portion 210 into which the inner container 100 is inserted may be formed in a side surface of the container body 200. Also, the open portion 210 may be formed in one or more side surfaces. For example, open portions 210 into which the inner container 100 is inserted may be formed in one or more of the side surfaces of the container body 200 of the cosmetic container. The open portion 210 into which the inner container 100 is inserted may be formed in any one among other surfaces excluding a side surface on which the button portion 230 formed at the container body 200 to open or close the upper cap 500 is mounted and a side surface on which a connecting portion connecting the upper cap 500 to the container body 200 is mounted.

According to other embodiments of the present invention, the open portion 210 into which the inner container 100 is inserted may be formed in a bottom surface of the container body 200. The inner container 100 may move from a bottom end to a top end to be inserted into the container body 200 through the open portion 210 formed in the bottom surface of the container body 200 and then may discharge contents therein while moving vertically or may be separated from the container body 200 while moving to the bottom end.

The open portion 210 into which the inner container 100 is inserted may have a greater breadth than a width of the storage portion 110 of the inner container 100. Also, according to one embodiment, the open portion 210 may have a width greater than or equal to a breadth of the outer circumferential portion 120 of the inner container 100.

Figure 5:
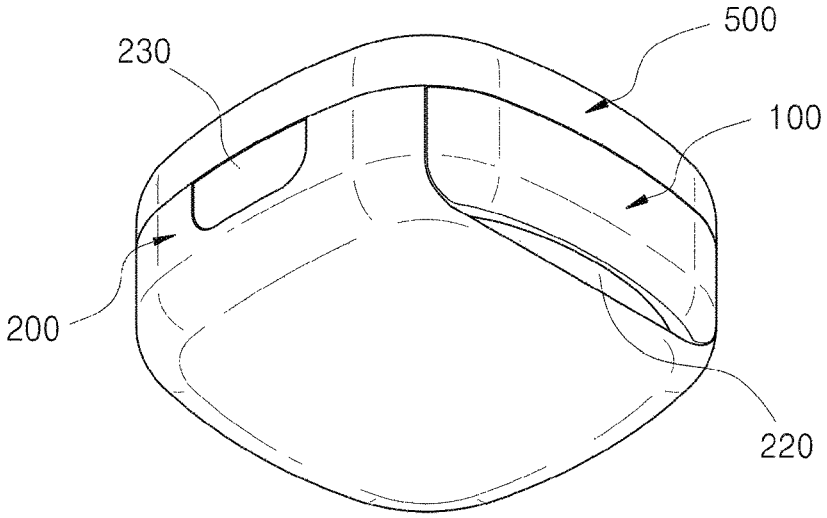
FIG. 5 is a bottom perspective view illustrating a bottom surface of the cosmetic container according to one embodiment of the present invention.

FIG. 5 is a bottom perspective view illustrating a bottom surface of the cosmetic container according to one embodiment of the present invention. Hereinafter, a description will be given with reference to FIG. 5.

A grip portion 220 is a component for easily inserting, removing, and/or pressurizing the inner container 100 and may be formed in the container body 200 or the inner container 100.

The grip portion 220 may be formed to have a groove or protrusion shape or may be formed as a space between containers.

A user may apply a pressure for inserting or pressurizing to the inner container 100 more easily by gripping the grip portion 220 when the inner container 100 is inserted or pressurized. For example, when it is necessary to separate the inner container 100 from the container body 200, the user inserts a finger into the grip portion 220 and pushes the inner container 100 toward an outside of the container body 200 so as to easily separate the inner container 100.

The grip portion 220 may be formed in a space between the open portion 210 of the container body 200 and the outer circumferential portion 120 of the inner container. In detail, when the open portion 210 is formed to have a greater size than that of the outer circumferential portion 120 of the inner container and the outer circumferential portion 120 of the inner container 100 protrudes outside the storage portion 110, a space is formed between the open portion 210 and the outer circumferential portion 120 of the inner container when the inner container 100 is inserted into the open portion 210. The user may utilize the space as the grip portion 220.

The grip portion 220 may be formed at the bottom end of the container body 200. Also, the grip portion 220 may be formed in a space between a bottom end of the inner container 100 coupled with the container body 200 and the bottom end of the container body 200.

When the grip portion 220 is formed at the bottom end of the container body 200, the user may separate the inner container 100 from the container body 200 more easily by inserting a finger into the grip portion 220 formed at the bottom end of the container body 200 while gripping the cosmetic container with one hand.

The container body 200 may include the button portion 230 on one side thereof, which is operated to open or close the upper cap 500. The button portion 230 may be formed on a side opposite to a side on which the connecting portion between the upper cap 500 and the container body 200 is disposed but is not limited thereto and may be located in any part of the container body 200. According to some embodiments, the button portion 230 may operate in a manner of being pressurized toward the inside of the cosmetic container or a manner of sliding in both directions along an outer circumferential part of the cosmetic container or in a vertical direction. The discharge means 300 may include a pump 310, a pump nozzle 320, and an elastic member 330.

The pump 310 discharges contents accommodated in the inner container and may include a cylinder and a piston.

The pump 310 may be an airless pump or a dip-tube type pump. In some embodiments, when an airless pump is used, the storage portion 110 of the inner container 100 may include a movable film or a movable piston moved within the storage portion 110 of the inner container 100 as a volume of a fluid is reduced by discharge. Also, when the airless pump is used, the storage portion 110 of the inner container 100 may be implemented as a pouch shape which contracts as a volume of a fluid is reduced by discharging contents.

The pump nozzle 320 is coupled with the pump 310 and delivers contents to the distributor 400. The pump nozzle 320 may be fastened to the container body 200 or the distributor 400 (particularly, the intermediate body 410) coupled with the container body 200 so as to be indirectly coupled with the container body 200.

When the inner container 100 is pressurized toward the inside of the container body 200, the elastic member 330 pushes the inner container 100 out in a direction opposite to a pressurizing direction. The elastic member 330 may return the pressurized inner container 100 to an original position thereof before being pressurized or may move the inner container 100 to a position in which the inner container 100 is removed more easily.

The elastic member 330 may be coupled with an outer surface of the pump 310. The elastic member 330 may be a spring but is not limited to the above example.

The discharge means 300 may be coupled with the inner container 100 and may be coupled with the container body 200. Also, a part of the discharge means 300 may be formed in the inner container 100 or another part thereof may be formed in the container body 200 or the distributor 400.

In one embodiment of the present invention, the pump 310 may be formed in the inner container 100, the pump nozzle 320 may be formed in the distributor 400, and the pump 310 may be coupled with the pump nozzle 320 when the inner container 100 is inserted into the container body 200. In another embodiment of the present invention, the pump 310 and the elastic member 330 may be formed in the inner container 100 and the pump nozzle 320 may be formed in the distributor 400.

Arrangements of the pump 310, the pump nozzle 320, and the elastic member 330 are not limited to the above embodiments and may be formed diversely.

The discharge means 300 may further include a backflow prevention member for preventing a backflow of a pumped fluid. In some embodiments, the backflow prevention member may be further disposed in the cylinder inside the pump 310. However, a position of the backflow prevention member with respect to the discharge means 300 is not limited and there is no limit in materials of the backflow prevention member. Due to the backflow prevention member, a fluid passing through the discharge means 300 may flow in only one direction.

The distributor 400 is a component which distributes contents discharged by the discharge means and may include the intermediate body 410, distributing plates 420 and 430, and a fixing cap 450.

The intermediate body 410 may be coupled with the discharge means 300 and may transfer contents discharged by the discharge means 300 to the distributing plates 420 and 430. Here, the intermediate body 410 may include a flow path 411 configured to transfer contents to the distributing plates 420 and 430.

A fluid discharged from the inner container 100 by pressurizing of the inner container 100 may sequentially flow through the pump nozzle 320 and the flow path 411 of the intermediate body 410 to be supplied to the distributing plates 420 and 430.

The intermediate body 410 may be fastened to the container body 200 through a fastening member provided below the intermediate body 410. An upper part of the intermediate body 410 may be fastened to the distributing plates 420 and 430 and the fixing cap 450 and a lower part thereof may be fastened to the container body 200.

The intermediate body 410 may be integrally formed with the distributing plates 420 and 430 or the fixing cap 450. Also, some or all of the intermediate body 410, the distributing plates 420 and 430, and the fixing cap 450 may be integrally formed.

The distributing plates 420 and 430 may distribute a fluid discharged by the inner container 100 coupled with the container body 200.

According to one embodiment of the present invention, the distributing plates 420 and 430 include an upper distributing plate 430 and a lower distributing plate 420.

The lower distributing plate 420 may include at least one hole for transferring a fluid to the upper distributing plate 430. In some embodiments, the hole of the lower distributing plate 420 may be one hole formed in a center of the lower distributing plate 420.

The upper distributing plate 430 may include a distribution path 431 so as to distribute contents discharged by the discharge means 300. The distribution path 431 may include a plurality of holes, grooves, and/or incised parts. The distribution path 431 may be formed and disposed to uniformly distribute a fluid induced through the hole of the lower distributing plate 420. The distribution path 431 may be formed to have a radial shape, a circular shape, or the like and to have an image capable of forming an aesthetic or a pattern such as a letter and a logo which are recognizable by the user. A shape of the distribution path 431 is not limited to the embodiment and may have a variety of shapes.

The upper distributing plate 430 may be formed of a hard material such that a shape thereof is not deformed by a pressure applied by a cosmetic tool such as a puff and the like. The upper distributing plate 430 may be formed of materials such as a metal, ceramic, synthetic resin, and the like.

The fixing cap 450 performs a function of fixing the distributing plates 420 and 430 and may fix the distributing plates 420 and 430 to the container body 200 by being fastened to the intermediate body 410 while being disposed on the upper distributing plate 430 and a top end of the lower distributing plate 420.

The fixing cap 450 may include an annular rib which protrudes upward to prevent a fluid distributed by the distributing plates 420 and 430 from flowing outside the distributing plates 420 and 430.

The upper distributing plate 430, the lower distributing plate 420, and the fixing cap 450 may be separately formed or some or an entirety thereof may be integrally formed. Some components may be omitted.

According to one embodiment of the present invention, when the coupled inner container 100 is pressurized, a fluid accommodated in the inner container 100 flows toward the pump nozzle 320 through the pump 310 and subsequently flows along the flow path 411 of the intermediate body 410 to be induced into the upper distributing plate 430 through the hole formed in the lower distributing plate 420. The induced fluid may be uniformly distributed on a surface of the upper distributing plate 430 while passing through the distribution path 431. The user may uniformly apply the fluid uniformly distributed on the surface of the upper distributing plate 430 to the face, body, or the like by using a cosmetic tool such as a puff and the like.

The distributor 400 may further include a mesh 440. The mesh 440 may be a flexible mesh including a plurality of micro holes. In some embodiments, the mesh 440 may include a single mesh or a plurality of meshes. The mesh may be manufactured using polyethylene (PE) materials or may include the same but is not limited thereto and may be manufactured using a variety of materials or may include the same. The mesh 440 may uniformly distribute cosmetic materials all over an entire surface of the mesh 440. In some embodiment, the mesh 440 may be disposed above the upper distributing plate 430 and may prevent the discharged cosmetic materials from flying from the upper distributing plate 430. Also, when contents are extracted by pressurizing the upper distributing plate 430 using a cosmetic tool such as a puff, it is necessary to allow an adequate amount of contents to be applied to the cosmetic tool.

According to one embodiment of the present invention, the cosmetic container may further include a dipping member instead of the distributing plates 420 and 430 or with the distributing plates 420 and 430. The dipping member may be filled with cosmetic materials induced into the distributing plates 420 and 430 or the intermediate body 410. In some embodiments, the dipping member may be formed of a porous material such as a sponge and may uniformly distribute cosmetic materials throughout an entirety of a capacity of the dipping member.

According to one embodiment of the present invention, the cosmetic container may further include an accommodating member capable of accommodating a cosmetic tool such as a puff. In some embodiments, the accommodating member may be disposed on the upper distributing plate 430. In some embodiments, the accommodating member may be formed for a cosmetic tool to be separated from the upper distributing plate 430 so as to not come into contact therewith. In some embodiments, the accommodating member may be formed to be connected to a part of the cosmetic container and be movable in a hinge manner.

The upper cap 500 performs a function of sealing the container body 200. The upper cap 500 may be connected to the container body 200 through a connecting portion such as a hinge formed on one side. The connecting portion may be configured to prevent the upper cap 500 from being separated from the container body 200 when the upper cap 500 is disposed in an open position. In another embodiment, the upper cap 500 may be connected to the intermediate body 410 through a connecting portion such as a hinge formed on one side.

The upper cap 500 may be directly coupled with the container body 200 without the connecting portion. For example, the upper cap 500 and the container body 200 may include a screw thread formed thereinside to be coupled with each other through mutual rotation.

According to one embodiment of the present invention, the cosmetic container may include a holding portion 510 configured to prevent the inner container 100 coupled with the container body 200 from being pressurized against the inside of the container body 200 while the upper cap 500 is closed.

In some embodiments, the holding portion 510 may be formed on the upper cap 500.

The holding portion 510 may be formed to protrude toward a bottom end of the upper cap 500 to be engaged with the top end of the coupled inner container 100. A shape of the holding portion 510 is not limited to the embodiment and may have a variety of shapes.

Also, one or more holding portions 510 may be formed along a circumferential part of the upper cap 500 or may be arranged to be spaced apart. The holding portion 510 may be formed to protrude from a vicinity of a coupling place of the inner container 100 to come into contact with a part of the inner container 100 and prevent the inner container 100 from being pressurized against the inside of the container body 200.

According to another embodiment of the present invention, the holding portion 510 may be formed on the inner container 100. In this case, when the upper cap 500 is closed, the inner container 100 coupled with the container body 200 is restrained by the holding portion 510, which is formed on the inner container 100, from moving into the container body 200.

The holding portion 510 may be formed corresponding to a direction in which the inner container is inserted. For example, when the inner container 100 is inserted through a left side surface of the container body 200, the holding portion 510 may be formed on a left side surface of the cosmetic container. When the inner container 100 is inserted through a right side surface of the container body 200, the holding portion 510 may be formed on a right side surface of the cosmetic container. When the inner container 100 is inserted through a front or rear surface of the container body 200, the holding portion 510 may be formed on a front or rear surface of the cosmetic container.

A mirror 520 may be attached to an inner surface of the upper cap 500. The user may check his or her own appearance in the mirror 520 and may apply a fluid distributed from the cosmetic container to the face, body, or the like. The mirror 520 may be formed of glass but is not limited thereto and may be manufactured using other materials or may include a variety of materials. Also, a shape of the mirror 520 may be a circular shape or a quadrangular shape but is not limited to the above examples. Also, according to one embodiment of the present invention, the mirror 520 may also be detachably attached to the upper cap 500.

The upper cap 500 may include a fastening portion 530 with, for example, a hook-shaped end on one side. When the user closes the upper cap 500 of the cosmetic container, a hook of the upper cap 500 is engaged with a recess in a concave part formed at a top end of the button portion 230 provided on the container body 200 such that the upper cap 500 remains in a closed position. When the user operates the button portion 230, the hook of the upper cap 500 is released from the recess of the button portion 230 such that the upper cap 500 may be movable to an opened position. In another embodiment, the hook type fastening portion 530 may be formed in the button portion 230 and a concave portion having a recess to be engaged with the hook-shaped holding portion may be formed in the upper cap 500.

Although a compact container is exemplified in one embodiment of the present invention, the present invention is not limited to the compact container and is applicable to a variety of cosmetic containers. In addition, the present invention is applicable not only to cosmetic products but also to the fields of medications, foods, and the like.

Figure 6:
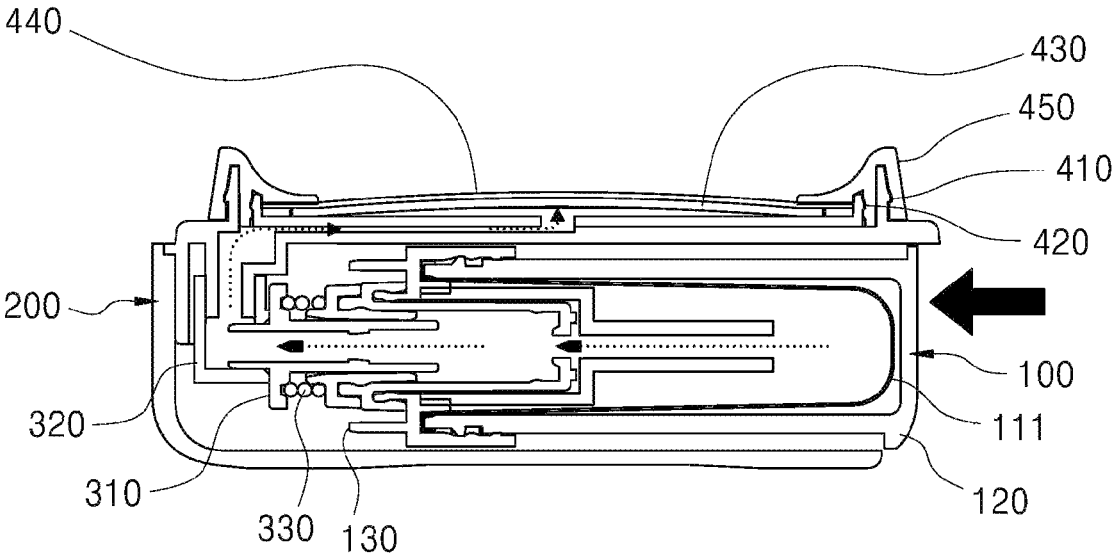
FIG. 6 is a view illustrating a state in which the inner container of the cosmetic container is pressurized against an inside of the container body according to one embodiment of the present invention.
Figure 7:
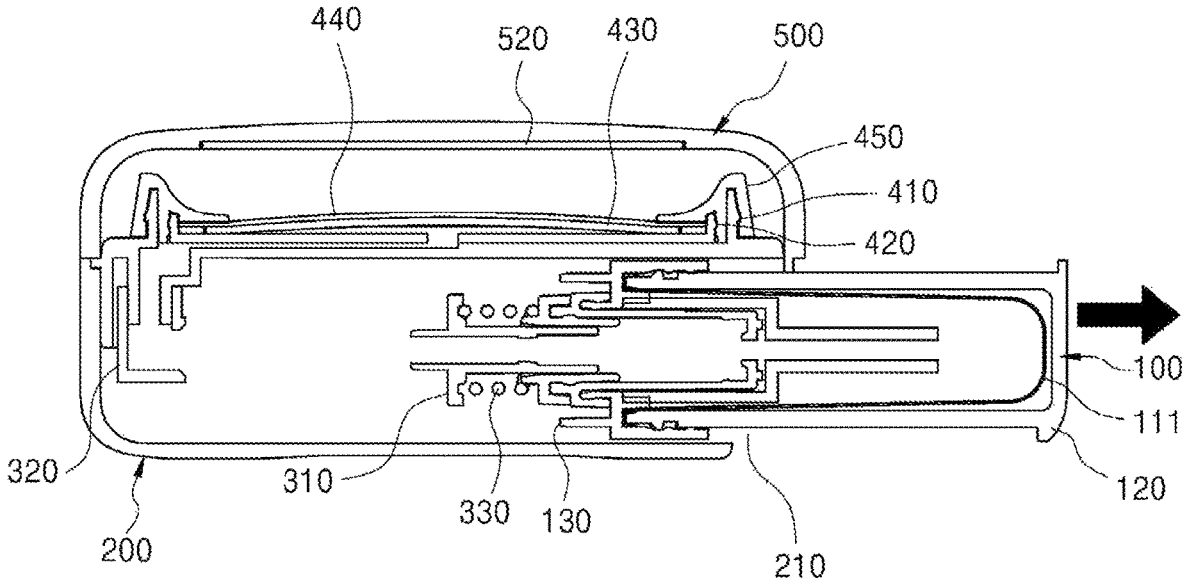
FIG. 7 is a view illustrating a state in which the inner container of the cosmetic container is separated from the container body according to one embodiment of the present invention.

FIG. 6 is a view illustrating a state in which the inner container of the cosmetic container is pressurized against the inside of the container body according to one embodiment of the present invention, and FIG. 7 is a view illustrating a state in which the inner container of the cosmetic container is separated from the container body according to one embodiment of the present invention. Hereinafter, discharging a fluid from the cosmetic container according to one embodiment of the present invention will be described with reference to FIGS. 6 and 7.

The inner container 100 may be inserted into the container body 200 and then be pressurized against the inside of the container body 200. When the holding portion 510 is formed on the upper cap 500 such that the upper cap 500 seals the container body 200, the holding portion 510 comes into contact with a part of the inner container 100 such that the inner container 100 inserted in the container body may be prevented from being pressurized against the inside of the container body 200. That is, the inner container 100 is not pressurized against the inside of the container body 200 while the upper cap 500 is closed such that it is possible to prevent contents from being discharged due to a malfunction.

When the upper cap 500 is opened and the inner container 100 is pressurized against the inside of the container body 200, the piston may be inserted into the cylinder connected to storage portion 110 in the inner container 100 to perform fluid communication such that a fluid in the inner container 100 may flow through the piston and the pump nozzle 320 and be discharged through the distributor 400.

When the coupled inner container 100 is pressurized, the fluid accommodated in the inner container 100 flows toward the pump nozzle 320 through the pump 310 and subsequently flows along the flow path 411 of the intermediate body 410 to be discharged into the upper distributing plate 430 through the hole formed in the lower distributing plate 420. The discharged fluid may be uniformly distributed on the surface of the upper distributing plate 430 while passing through the distribution path 431. The user may apply the fluid uniformly distributed on the surface of the upper distributing plate 430 uniformly to the face, body, or the like by using a cosmetic tool such as a puff and the like.

When the pressure is released, the inner container 100 pressurized by the elastic member 330 returns to an original position thereof before being pressurized. The user may continuously discharge contents by pressurizing the inner container 100 against the inside of the container body 200 again as necessary.

An amount of the discharged fluid may be determined according to a pressurizing force, a number of instances of pressurizing, a pressurizing degree, and/or a pressurizing time while the inner container 100 is pressurized against the inside of the container body 200. An amount of the fluid discharged at one time may be a certain amount.

When all the contents in the inner container 100 are exhausted, the user may separate the inner container 100 from the container body 200 through the open portion 210. The inner container 100 may be completely separated and removed from the container body 200.

The user may remove the existing inner container 100 from the container body 200 and insert a new inner container into the container body 200 to use as necessary. For example, when it is necessary to replace the inner container 100 in which all the fluid is exhausted or to use a new inner container in which a different fluid is accommodated, the user may replace the inner container.

Hereinafter, a method of using the cosmetic container according to one embodiment of the present invention will be described.

A user of the cosmetic container according to one embodiment of the present invention may insert or remove the inner container 100 into or from the container body 200 while gripping the cosmetic container with one hand. For example, a user, who uses the cosmetic container according to one embodiment of the present invention in FIG. 1, may grip the cosmetic container with one hand, open the upper cap 500, and then discharge contents by pressurizing the inner container 100 on the side surface of the cosmetic container against the inside of the container body 200 using a thumb. Also, the inner container 100 may be separated from the container body 200 by inserting a finger into the grip portion 220 formed in a space between the open portion 210 of the container body 200 and the outer circumferential portion 120 of the inner container. The user may insert, remove, or replace the inner container 100 into or from the container body 200 using only one hand more easily instead of using both hands.

Although the limited embodiments have been described above with reference to the drawings, a variety of modifications and changes may be made by one of ordinary skill in the art from the above invention. For example, although the above-described structure and components such as a device and the like are coupled or combined in a different way from the above-described method or are substituted or replaced with other components or equivalents, an adequate result may be obtained. Therefore, other implements, other embodiments, and equivalents of the following claims will be included within the scope of the claims.

The invention claimed is:

1. A cosmetic container comprising:

an inner container configured to store contents;

a container body configured to accommodate the inner container;

a discharger configured to discharge the contents stored in the inner container;

a distributor configured to distribute the contents discharged by the discharger; and an upper cap configured to seal the container body, wherein an opening is defined on one side of the container body, the inner container is insertable into the container body through the opening, and the inner container is separable from the container body through the opening, wherein the inner container includes a storage configured to store the contents therein and an outer circumferential portion disposed to protrude outward to have a greater width than that of the storage while surrounding at least one surface of the storage and configured to define one surface of the container body by smoothly connecting an outer surface of the outer circumferential portion and an outer surface of the container body when the inner container is inserted into the container body, wherein the upper cap includes a holding portion configured to, when the upper cap seals the container body, prevent the discharge of the contents by the discharger while the inner container inserted into the container body is pressed toward an inner side of the container body, wherein the holding portion is disposed to protrude downward along a circumference of the upper cap, and when the upper cap seals the container body, comes into contact with an inner side surface of the outer circumferential portion and limits the pressing of the inner container toward the inner side of the container body by limiting a movement of the outer circumferential portion toward an inner side of the holding portion, and allows separation of the inner container toward an outer side of the container body, and wherein when the upper cap seals the container body and the holding portion comes into contact with the inner side surface of the outer circumferential portion, the outer surface of the outer circumferential portion is smoothly connected to an outer surface of the upper cap.

2. The cosmetic container of claim 1, wherein the opening is defined on a side surface of the container body.

3. The cosmetic container of claim 1, wherein the discharger comprises a pump and a pump nozzle.

4. The cosmetic container of claim 3, wherein the pump is disposed in the inner container, the pump nozzle is disposed in the distributor, and the pump is coupled to the pump nozzle when the inner container is inserted into the container body.

5. The cosmetic container of claim 3, wherein the pump is an airless pump or a dip tube type pump.

6. The cosmetic container of claim 5, wherein, when the pump is an airless pump, the inner container includes a movable film or a piston or is a contractible pouch.

7. The cosmetic container of claim 1, wherein, when the inner container is inserted into the container body and the inner container is pressed toward the inner side of the container body, the contents stored in the inner container is discharged to the distributor by the discharger.

8. The cosmetic container of claim 1, wherein the upper cap includes one or more holding portions disposed along the circumference of the upper cap.

9. The cosmetic container of claim 1, wherein a grip portion configured to allow a portion of the inner container to be gripped is defined at the one side of the container body.

10. The cosmetic container of claim 9, wherein the grip portion is defined in a separation space between the opening of the container body and the outer circumferential portion of the inner container.

11. The cosmetic container of claim 1, wherein the distributor comprises:

an intermediate body to which the discharger is coupled; and a distribution plate coupled to an upper portion of the intermediate body and configured to distribute the contents.

12. The cosmetic container of claim 11, wherein a distribution path is defined in the distribution plate and the contents discharged by the discharger is distributed through the distribution path.

13. The cosmetic container of claim 1, wherein the distributor includes a mesh.

* * * * *